US006581689B2

(12) United States Patent
Hailey, Jr.

(10) Patent No.: US 6,581,689 B2
(45) Date of Patent: Jun. 24, 2003

(54) SCREEN ASSEMBLY AND METHOD FOR GRAVEL PACKING AN INTERVAL OF A WELLBORE

(75) Inventor: Travis T. Hailey, Jr., Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/894,037

(22) Filed: Jun. 28, 2001

(65) Prior Publication Data

US 2003/0000700 A1 Jan. 2, 2003

(51) Int. Cl.[7] ..... E21B 43/04

(52) U.S. Cl. ..... 166/278; 166/51; 166/228; 166/234

(58) Field of Search ..... 166/278, 276, 166/280, 51, 228, 230, 233, 234

(56) References Cited

U.S. PATENT DOCUMENTS

| | | | | |
|---|---|---|---|---|
| 2,342,913 A | | 2/1944 | Williams et al. | |
| 2,344,909 A | | 3/1944 | Williams et al. | |
| 4,945,991 A | | 8/1990 | Jones | 166/278 |
| 5,082,052 A | | 1/1992 | Jones et al. | 166/51 |
| 5,113,935 A | * | 5/1992 | Jones et al. | 166/51 |
| 5,161,613 A | | 11/1992 | Jones | 166/242 |
| 5,161,618 A | | 11/1992 | Jones et al. | 166/308 |
| 5,333,688 A | | 8/1994 | Jones et al. | 166/278 |
| 5,355,948 A | * | 10/1994 | Sparlin et al. | 166/228 |
| 5,355,956 A | | 10/1994 | Restarick | 166/296 |
| 5,390,966 A | | 2/1995 | Cox et al. | 285/137.1 |
| 5,419,394 A | | 5/1995 | Jones | 166/51 |
| 5,443,117 A | | 8/1995 | Ross | 166/51 |
| 5,476,143 A | | 12/1995 | Sparlin et al. | 166/233 |
| 5,515,915 A | | 5/1996 | Jones et al. | 166/51 |
| 5,588,487 A | | 12/1996 | Bryant | 166/51 |
| 5,636,691 A | | 6/1997 | Hendrickson et al. | 166/278 |
| 5,755,286 A | | 5/1998 | Ebinger | 166/281 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Frac Pack Technology Still Evolving," Charles D. Ebinger of Ely & Associates Inc.; Oil & Gas Journal, Oct. 23, 1995.
"Mechanical Fluid–Loss Control Systems Used During Sand Control Operations," H.L. Restarick of Otis Engineering Corp., 1992.
"Sand Control Screens," Halliburton Energy Services, 1994.
"Screenless Single Trip Multizone Sand Cotrol Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

(List continued on next page.)

*Primary Examiner*—David Bagnell
*Assistant Examiner*—Zakiya Walker
(74) *Attorney, Agent, or Firm*—Lawrence R. Youst

(57) ABSTRACT

A screen assembly (60) comprises a base pipe (62) having perforated and nonperforated sections (66, 68), ribs (70) circumferentially spaced therearound and a filter medium (84) positioned around the ribs (70) having voids (92, 94) therethrough. The screen assembly (60) includes a slurry passageway (98) defined by the nonperforated section (68) of the base pipe (62), two of the ribs (70) and the portion (100) of the filter medium (84) that is circumferentially aligned with the nonperforated section (68). This portion (100) of the filter medium (84) has a filler material (96) disposed within the voids (92, 94) to create a fluid tight seal for a fluid slurry. The fluid slurry is discharged from the screen assembly (60) to a plurality of levels of the interval through exit ports (106) in a plurality of manifolds (102) when the screen assembly (60) is in an operable position.

38 Claims, 6 Drawing Sheets

U.S. PATENT DOCUMENTS

| | | | | |
|---|---|---|---|---|
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,343,651 | B1 | 2/2002 | Bixenman | 166/278 |
| 2002/0174984 | A1 * | 11/2002 | Jones | |

OTHER PUBLICATIONS

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

"CAPS$^{SM}$ Concentric Annular Packing Service for Sand Control," Halliburton Energy Services, Inc., Aug., 2000.

"Caps$^{SM}$ Sand Control Service for Horizontal Completions Improves Gravel Pack Reliability and Increases Production Potential from Horizontal Completions," Halliburton Energy Services, Inc., Aug., 2000.

* cited by examiner

SCREEN ASSEMBLY AND METHOD FOR GRAVEL PACKING AN INTERVAL OF A WELLBORE

TECHNICAL FIELD OF THE INVENTION

This invention relates in general to preventing the production of particulate materials through a wellbore traversing an unconsolidated or loosely consolidated subterranean formation and, in particular, to a screen assembly and method for obtaining a substantially complete gravel pack within an interval of the wellbore.

BACKGROUND OF THE INVENTION

Without limiting the scope of the present invention, its background is described with reference to the production of hydrocarbon fluids through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate cause abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent to the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge.

It has been found, however, that shunt tubes installed on the exterior of sand control screens are susceptible to damage during installation and may fail during a gravel packing operation. In addition, it has been found that on site assembly of a shunt tube system around a sand control screen is difficult and time consuming due to the large number of fluid connections required for typical production intervals. Further, it has been found that the effective screen area available for filtering out particulate from the production fluids is reduced when shunt tubes are installed on the exterior of a sand control screen.

Therefore a need has arisen for an apparatus and method for gravel packing a production interval traversed by a wellbore that overcomes the problems created by sand bridges. A need has also arisen for such an apparatus that is not susceptible to damage during installation and will not fail during a gravel packing operation. Additionally, a need has arisen for such an apparatus that is cost effective and does not require difficult or time consuming on site assembly. Further, a need has arisen for such an apparatus that does not require a reduction in the effective screen area available for filtering out particulate from the production fluids.

SUMMARY OF THE INVENTION

The present invention disclosed herein comprises a screen assembly and method for gravel packing a production interval of a wellbore that traverses an unconsolidated or loosely consolidated formation that overcomes the problems created by the development of a sand bridge between a sand control screen and the wellbore. Importantly, the screen assembly of the present invention is not susceptible to damage during installation or failure during the gravel packing operation, is cost effective to manufacture and does not require difficult or time consuming on site assembly. In addition, the screen assembly of the present invention allows for a relatively large effective screen area for filtering out particulate from the production fluids.

The sand control screen assembly of the present invention comprises a base pipe that has one or more perforated sections and one or more nonperforated sections. A plurality of ribs are circumferentially spaced around and axially extending along the exterior surface of the base pipe. Two of the ribs are positioned within each of the nonperforated sections of the base pipe. A screen wire is wrapped around the plurality of ribs forming a plurality of turns having gaps therebetween. A filler material is disposed within the portions of the gaps that are circumferentially aligned with the nonperforated sections of the base pipe.

The screen assembly includes one or more slurry passageways each of which are defined by one of the nonperforated section of the base pipe, the two ribs positioned within that nonperforated section of the base pipe and the portion of the wire and the filler material in the gaps that are circumferentially aligned with that nonperforated section of the base pipe. The slurry passageways are used to carry a fluid slurry containing gravel past any sand bridges that may form in the annulus surrounding the screen assembly. The fluid slurry is discharged from the screen assembly via a plurality of manifolds that are in fluid communication with the slurry passageways. The manifolds selectively discharge the fluid slurry to a plurality of levels of the interval through exit ports formed therein when the screen assembly is in an operable position. The exit ports may be either circumferentially aligned with the slurry passageways, circumferentially misaligned with the slurry passageways or both. The fluid communication between the manifolds and the slurry passageways may be established using tubes that extend from the manifolds into each adjacent sections of the slurry passageways.

In embodiments of the present invention wherein the screen assembly includes more than one section of sand control screen, each including a portion of the slurry passageway, the screen assembly includes a manifold between each of the sand control screen sections. These manifolds provide fluid communication between the portions of the slurry passageways of the adjacent sand control screen sections and deliver the fluid slurry into the interval surrounding the screen assembly.

In one embodiment of the present invention, the exit ports are created directly through the wire and the filler material in the gaps that are circumferentially aligned with the nonperforated sections of the base pipe instead of in manifolds. In this embodiment, tube segments may be disposed within the slurry passageways at the locations where the exit ports are created to provide support to the screen wire at these locations.

The method of the present invention includes traversing a formation with the wellbore, positioning a sand control screen assembly having one or more slurry passageways as described above, within the wellbore, injecting a fluid slurry containing gravel through the slurry passageways such that the fluid slurry exits the screen assembly through exit ports in manifolds or through the screen wire at a plurality of levels of the interval and terminating the injecting when the interval is substantially completely packed with the gravel.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
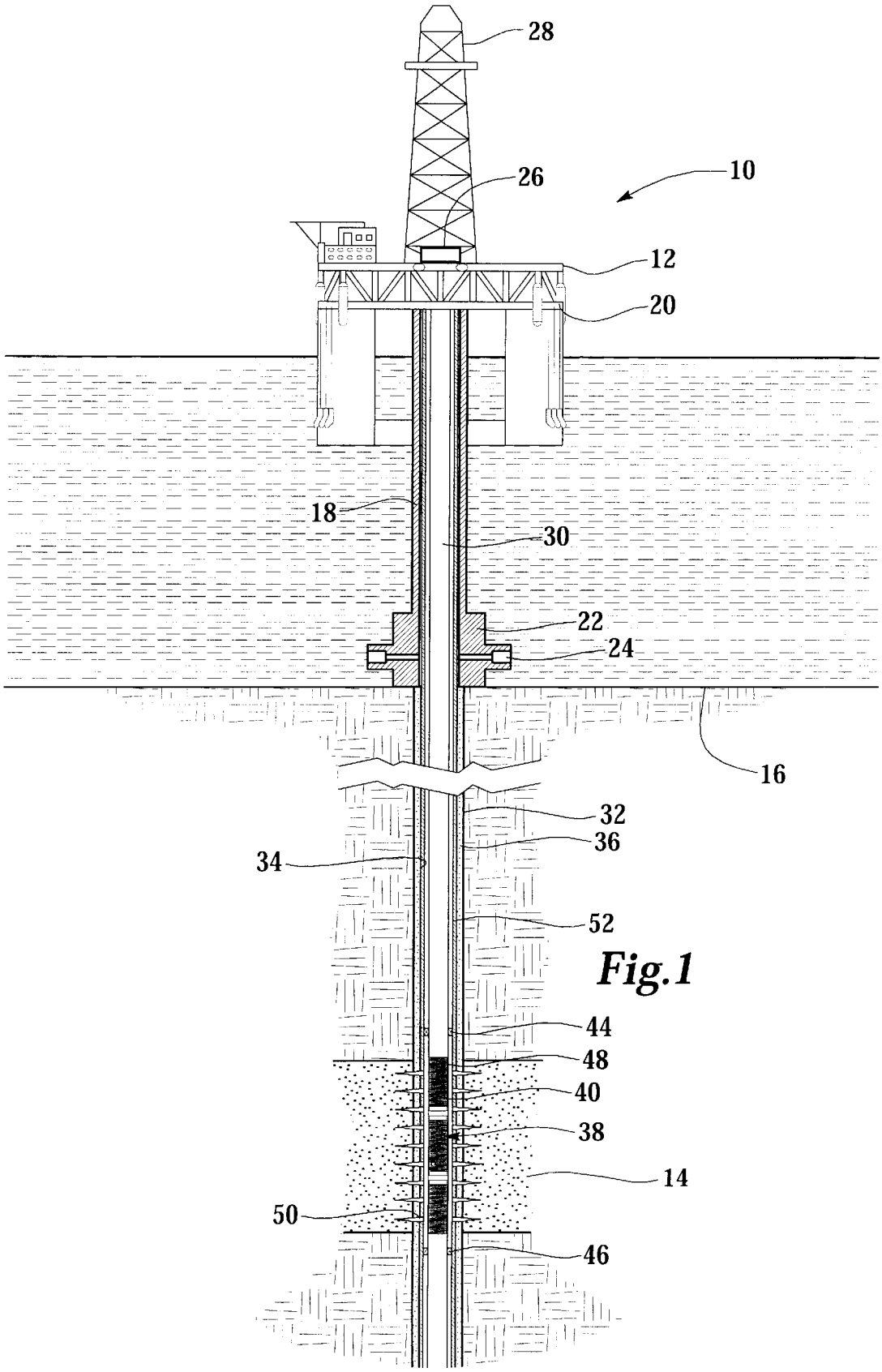
FIG. 1 is a schematic illustration of an offshore oil and gas platform operating a sand control screen assembly for gravel packing an interval of a wellbore of the present invention.

Referring initially to FIG. 1, a sand control screen assembly for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools for completing the well. On the lower end of work string 30 is a sand control screen assembly 38 for gravel packing an interval of wellbore 32 made up of a plurality of sections of sand control screens 40, three of which are depicted in FIG. 1. Sand control screen assembly 38 is positioned adjacent to formation 14 between packers 44, 46 in annular region or interval 48 including perforations 50. When it is desired to gravel pack annular interval 48, a fluid slurry including a liquid carrier and a particulate material such as gravel is pumped down work string 30.

As explained in more detail below, the fluid slurry will generally be injected into annular interval 48 between screen assembly 38 and wellbore 32 in a known manner such as through a cross-over tool (not pictured) which allows the slurry to travel from the interior of work string 30 to the exterior of work string 30. Once the fluid slurry is in annular interval 48, a portion of the gravel in the fluid slurry is deposited in annular interval 48. Some of the liquid carrier may enter formation 14 through perforation 50 while the remainder of the fluid carrier entering sand control screen assembly 38. More specifically, sand control screen assembly 38 disallows further migration of the gravel in the fluid slurry but allows the liquid carrier to travel therethrough and up to the surface in a known manner, such as through a wash pipe and into the annulus 52 above packer 44.

If a sand bridge forms during the injection of the fluid slurry into annular region 48, the fluid slurry will be diverted into one or more slurry passageways in sand control screen assembly 38 to bypass this sand bridge. In this case, the fluid slurry will be discharged from sand control screen assembly 38 through exit port at various levels within interval 48. Again, once in annular interval 48, the gravel in the fluid slurry is deposited therein. Some of the liquid carrier may enter formation 14 through perforation 50 while the remainder of the fluid carrier enters sand control screen assembly 38, as described above, and returns to the surface. The operator continues to pump the fluid slurry down work string 30 into annular interval 48 and through the slurry passageways of sand control screen assembly 38, as necessary, until annular interval 48 surrounding sand control screen assembly 38 is filled with gravel, thereby achieving a complete pack of interval 48. Alternatively, it should be noted by those skilled in the art, that the fluid slurry may be injected entirely into the slurry passageways of sand control screen assembly 38 without first injecting the fluid slurry directly into annular interval 48.

Even though FIG. 1 depicts a vertical well, it should be noted by one skilled in the art that the screen assembly for gravel packing an interval of a wellbore of the present invention is equally well-suited for use in deviated wells, inclined wells or horizontal wells. In addition, it should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Also, even though FIG. 1 depicts an offshore operation, it should be noted by one skilled in the art that the screen assembly for gravel packing an interval of a wellbore of the present invention is equally well-suited for use in onshore operations. Further, even though FIG. 1 has been described with regard to a gravel packing operation, it should be noted by one skilled in the art that the screen assembly of the present invention is equally well-suited for fracture operations and frac pack operations wherein a fluid slurry containing propping agents is delivered at a high flow rate and at a pressure above the fracture pressure of formation 14 such that fractures may be formed within formation 14 and held open by the propping agents and such that annular interval 48 is packed with the propping agents or other suitable particulate materials to prevent the production of fines from formation 14.

Figure 2:
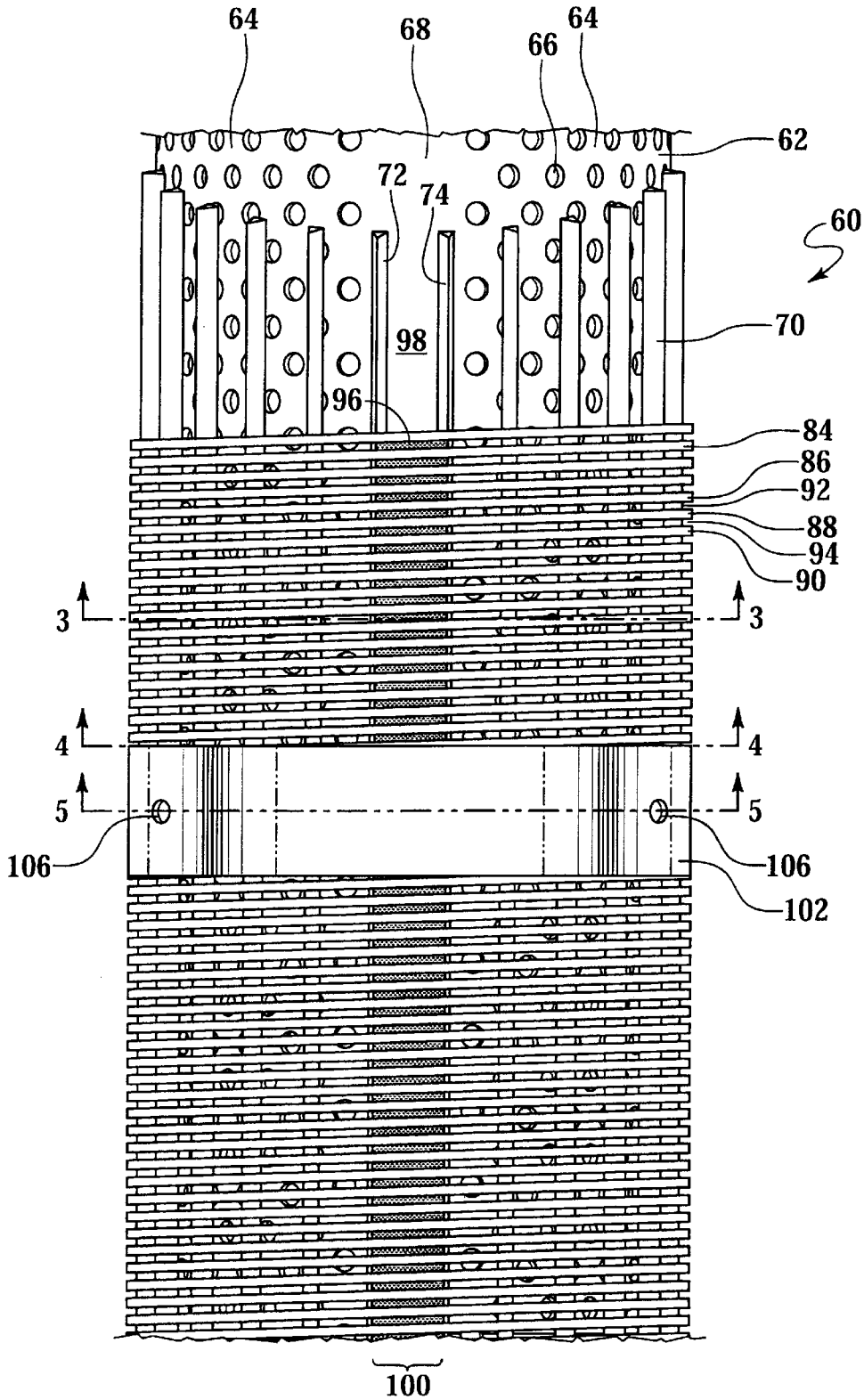
FIG. 2 is partial cut away view of a sand control screen assembly for gravel packing an interval of a wellbore of the present invention.
Figure 3:
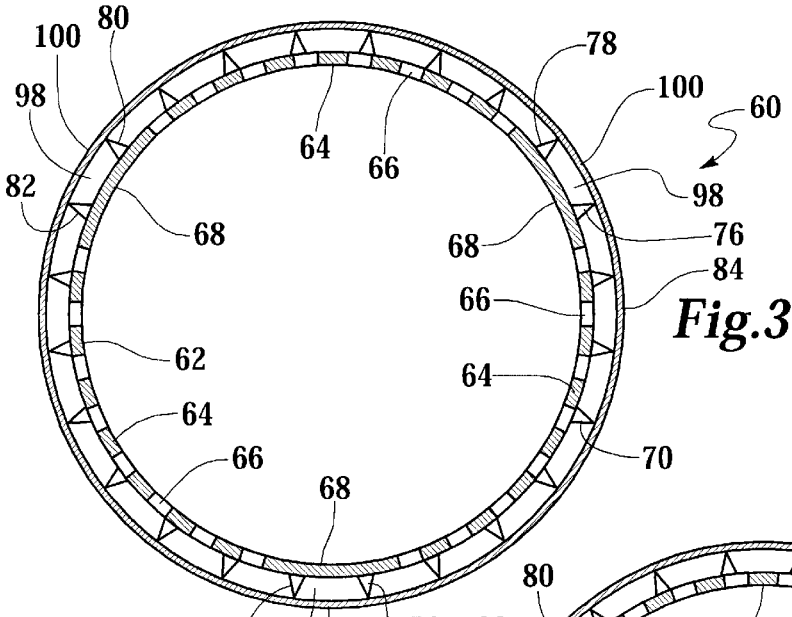
FIG. 3 is cross sectional view of the sand control screen assembly for gravel packing an interval of a wellbore of FIG. 2 taken along line 3—3.

Referring now to FIG. 2, therein is depicted a partial cut away view of a sand control screen assembly for gravel packing an interval of a wellbore of the present invention that is generally designated 60. Screen assembly 60 has a base pipe 62 that has a plurality of perforated sections and a plurality of nonperforated sections. In the illustrated embodiment and as best seen in FIG. 3, screen assembly 60 has three perforated sections 64 each of which include a plurality of openings 66. The exact number, size and shape of openings 66 are not critical to the present invention, so long as sufficient area is provided for fluid production and the integrity of base pipe 62 is maintained. Screen assembly 60 also has three nonperforated sections 68 which are positioned at approximately 120 degree intervals from one another.

Circumferentially distributed around and axially extending along the outer surface of base pipe 62 is a plurality of ribs 70. In the illustrated embodiment, ribs 70 are generally symmetrically distributed about the axis of base pipe 62. Preferably, ribs 70 have a generally triangular cross section wherein the base portion of ribs 70 that contacts base pipe 62 has an arcuate shape that substantially matches the curvature of base pipe 62. Alternatively, the base portion of ribs 70 may be shaped such that ribs 70 contact base pipe 62 only proximate the apexes of the base portion of ribs 70. In either case, once screen assembly 60 is fully assembled, the base portion of ribs 70 should securely contact base pipe 62 and provide the necessary fluid seal at the locations where the base portion of ribs 70 contact base pipe 62. Importantly, two of the ribs 70 are positioned against each of the nonperforated sections 68 of base pipe 62. Specifically, ribs 72, 74, ribs 76, 78 and ribs 80, 82 are respectively positioned against nonperforated sections 68.

Even though ribs 70 have been described as having a generally triangular cross section, it should be understood by one skilled in the art that ribs 70 may alternatively have other cross sectional geometries including, but not limited to, rectangular and circular cross sections so long as a proper seal between the ribs and the base pipe is established. Additionally, it should be understood by one skilled in the art that the exact number of ribs 70 will be dependent upon factors such as the diameter of base pipe 62, the width of nonperforated sections 68, as well as other design characteristics that are well known in the art.

Wrapped around and welded to ribs 70 is a screen wire 84. Screen wire 84 forms a plurality of turns, such as turn 86, turn 88 and turn 90. Between each of the turns is a void or gap through which formation fluids flow such as gap 92 between turns 86, 88 and gap 94 between turns 88, 90. The number of turns and the gap between the turns are determined based upon factors such as the characteristics of the formation from which fluid is being produced and the size of the gravel to be used during the gravel packing operation. As illustrated, the gaps in the sections of screen wire 84 that are circumferentially aligned with nonperforated sections 68 of base pipe 62 are sealed with a filler material 96 such as an epoxy resin. Filler material 96 is selectively placed in the gaps between the turns of screen wire 84 such that fluid sealed slurry passageways 98 are created between respective nonperforated sections 68, ribs 70 and sealed sections 100 of screen wire 84.

Together, ribs 70 and screen wire 84 may form a sand control screen jacket that is attached to base pipe 62 by welding or other suitable technique forming each screen section of screen assembly 60. Alternatively, screen wire 84 may be wrapped around and welded to ribs 70 in place against base pipe 62. It should be noted by those skilled in the art that even though FIG. 2 has depicted a wire wrapped screen, other types of filter media could alternatively be placed over ribs 70 without departing from the principles of the present invention including, but not limited to, a fluid-porous, particulate restricting, sintered metal material such as a plurality of layers of a wire mesh that are sintered together to form a porous sintered wire mesh screen that is seam welded or spiral welded over ribs 70.

Figure 4:
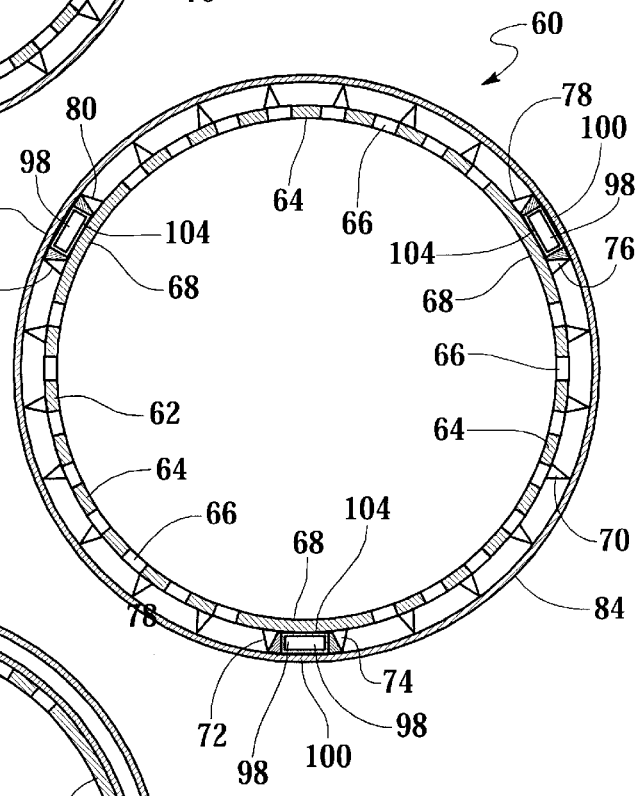
FIG. 4 is cross sectional view of the sand control screen assembly for gravel packing an interval of a wellbore of FIG. 2 taken along line 4—4.
Figure 5:
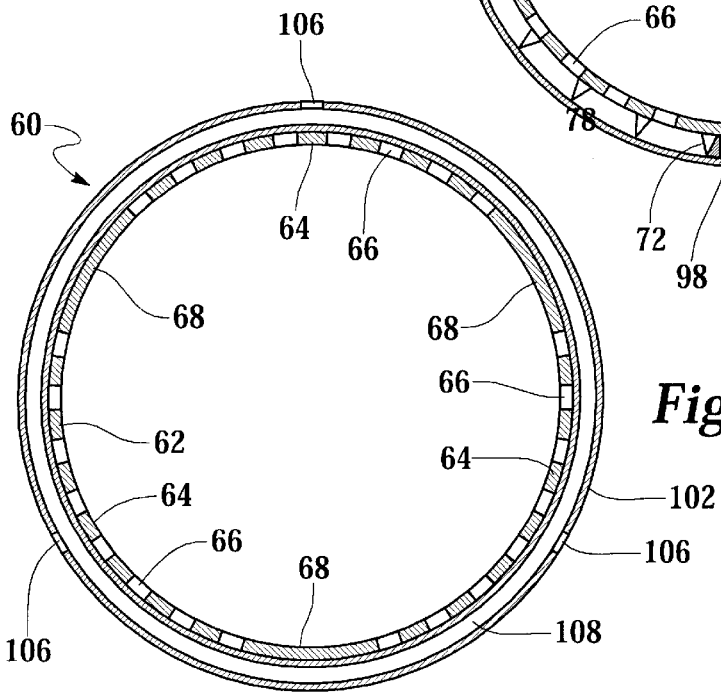
FIG. 5 is cross sectional view of the sand control screen assembly for gravel packing an interval of a wellbore of FIG. 2 taken along line 5—5.

Positioned at selected intervals, such as every five to ten feet, along each screen section of sand control screen assembly 60 is a manifold 102. Manifold 102 is in fluid communication with slurry passageways 98 via tubes 104 which extend partially into slurry passageways 98, as best seen in FIG. 4. In the illustrated embodiment, tubes 104 are welded within slurry passageways 98. Tubes 104 deliver the fluid slurry carried in slurry passageways 98 into manifold 102. A portion of the fluid slurry in manifold 102 will enter the annular interval surrounding screen assembly 60 via exit ports 106. The remainder of the fluid slurry passes through annular area 108 of manifold 102 and enters the next section of slurry passageways 98, as best seen in FIG. 5. This process continues through the various levels of screen assembly 60 along the entire length of the interval to be gravel packed such that a complete gravel pack of the interval can be achieved.

In the illustrated embodiment, exit ports 106 of manifold 102 are not circumferentially aligned with slurry passageways 98 of screen assembly 60. This configuration helps to minimize liquid leak off after the area adjacent to a particular manifold has been packed with the gravel. Specifically, even after an area surrounding one of the manifolds has been packed with the gravel, it has been found that liquid from the fluid slurry may nonetheless leak off into this porous region causing not only a reduction in the velocity of the fluid slurry in slurry passageways 98, but also, an increase in the effective density of particles in the fluid slurry, each of which is a hindrance to particle transport to locations further along screen assembly 60. Positioning exit ports 106 out of phase with slurry passageways 98 reduces the liquid leak off by increasing the pressure required to push the liquid through the porous matrix and reduces the velocity of the liquid near exit ports 106, thereby reducing the rate of liquid leak off. This rate of liquid leak off is further reduced by using a liquid in the fluid slurry that is thixotropic such that its viscosity increases with reduced velocity through the porous matrix.

Even though FIG. 2 has depicted exit ports 106 as being circular, it should be understood by those skilled in the art that exit ports 106 could alternatively have other shapes without departing from the principles of the present invention, those shapes being considered within the scope of the present invention. Also, it should be noted by those skilled in the art that even though FIGS. 2–4 have depicted three slurry passageways 98 at 120 degree intervals around screen assembly 60, other numbers of slurry passageways, either greater or fewer, and other intervals between such slurry passageways may be used without departing from the principles of the present invention and are considered within the scope of the present invention. Likewise, even though FIGS. 2 and 5 have depicted three exit ports 106 at 120 degree intervals around manifold 102, other numbers of exit port, either greater or fewer, and other intervals between such exit ports may be used without departing from the principles of the present invention and are considered within the scope of the present invention.

Figure 6:
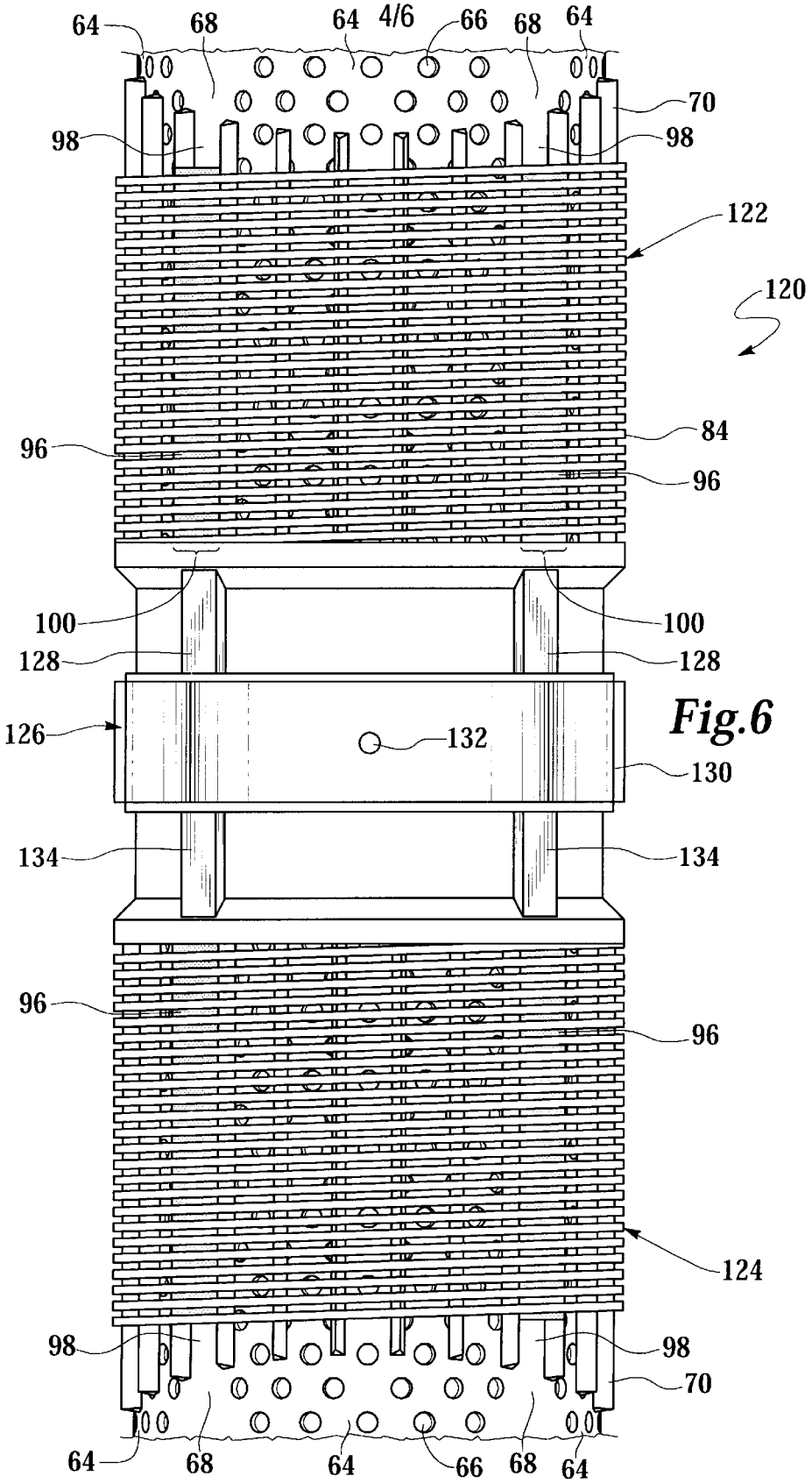
FIG. 6 is a side view of two adjacent sand control screens of a sand control screen assembly for gravel packing an interval of a wellbore of the present invention.

Referring now to FIG. 6, therein is depicted a screen assembly for gravel packing an interval of a wellbore at the point where two sand control screens are joined together, that is generally designated 120. As illustrated, screen assembly 120 includes sand control screen 122 and sand control screen 124 each of which have the substantially identical construction as that described above with reference with reference to FIGS. 2–5. Screens 122, 124 are coupled together in a known manner such as via a threaded coupling (not pictured). Between screens 122, 124, screen assembly 120 includes a tube and manifold system 126. Tube and manifold system 126 includes three tubes 128, only two of which are pictured, that deliver the fluid slurry from slurry passageways 98 of screen 122 to manifold 130. A portion of the fluid slurry in manifold 130 will enter the annular interval surrounding screen assembly 120 via three exit ports 132, only one of which is shown. The remainder of the fluid slurry enters three tubes 134, only two of which are pictured, and is delivered to slurry passageways 98 of screen 124.

Even though FIG. 6 depicts tubes 128 that deliver the fluid slurry to manifold 130 as being circumferentially aligned with tubes 134 that transport the fluid slurry from manifold 130, it is likely that tubes 128, 134 will not be circumferentially aligned as the adjoining sections of tube and manifold system 126 are threadably coupled when screen sections 122, 124 of screen assembly 120 are threaded together. Accordingly, it is likely that tubes 128 and tubes 134 on opposite sides of manifold 130 will not be circumferentially aligned with one another.

As should be apparent to those skilled in the art, even when tubes 128 and tubes 134 are positioned with a circumferential phase shift relative to one another, this does not affect the operation of the present invention as manifold 130 has a substantially annular region, such as annular region 108 depicted in FIG. 5, through which the fluid slurry travels allowing for such misalignment. As such, the mating of adjoining sections of the screen assembly for gravel packing an interval of a wellbore of the present invention is substantially similar to mating typical joints of pipe to form a pipe string requiring no special coupling tools or techniques.

Figure 7:
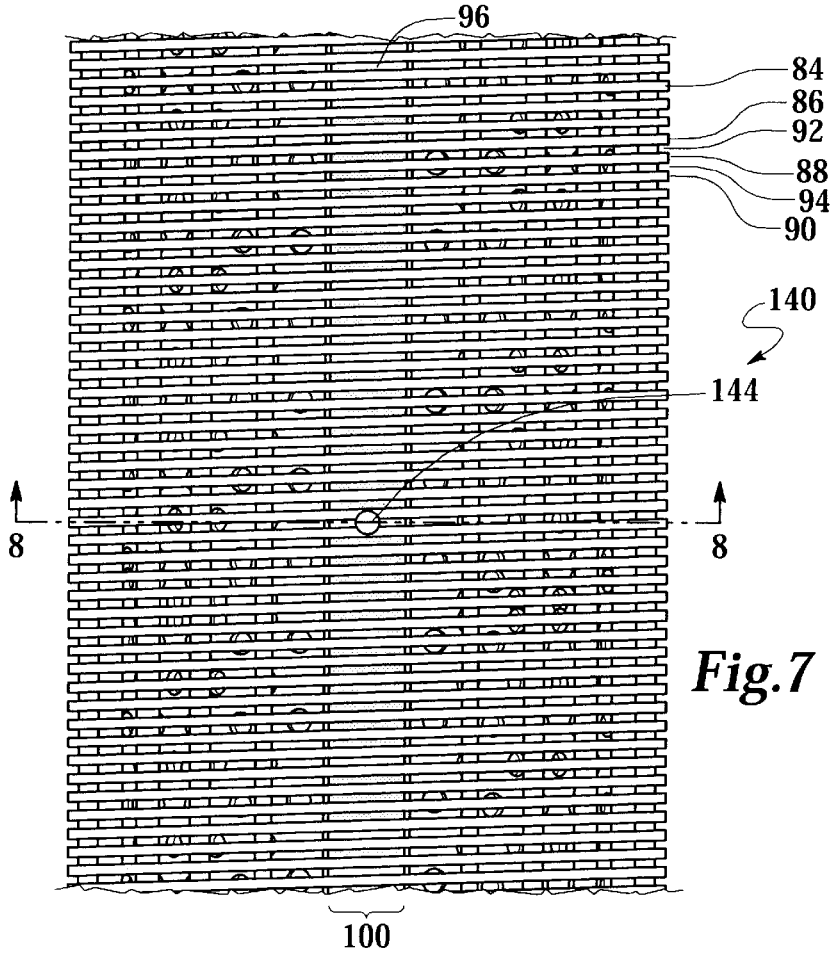
FIG. 7 is side view of a sand control screen assembly for gravel packing an interval of a wellbore of the present invention.
Figure 8:
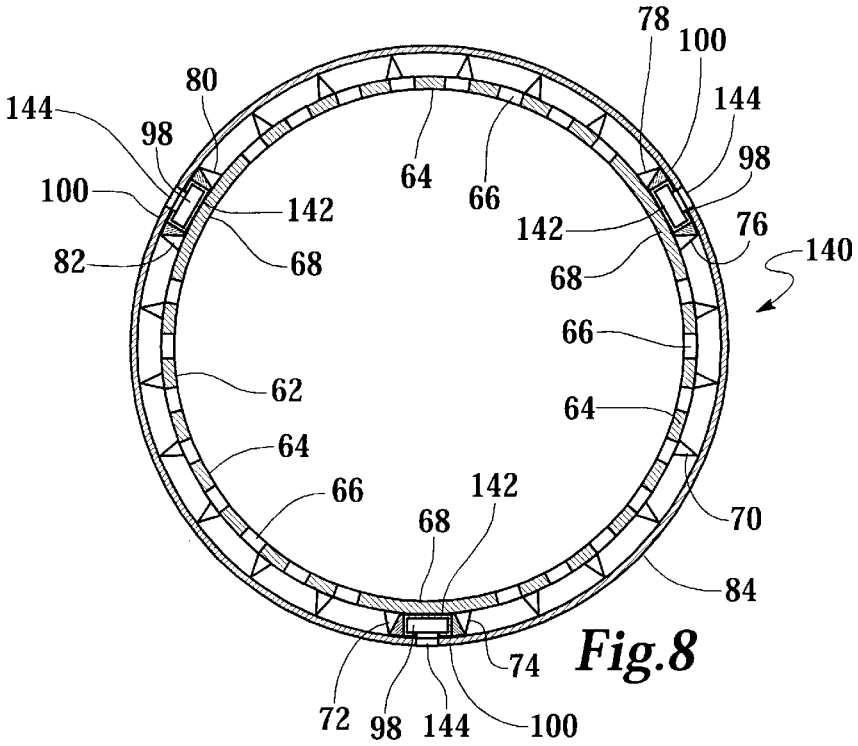
FIG. 8 is a cross sectional view of the sand control screen assembly for gravel packing an interval of a wellbore of FIG. 7 taken along line 8—8.

Referring now to FIGS. 7 and 8, therein is depicted another embodiment of a screen assembly for gravel packing an interval of a wellbore that is generally designated 140. Screen assembly 140 includes a base pipe 62 that has three perforated sections 64 having openings 66 and three nonperforated sections 68. Circumferentially distributed around and axially extending along the outer surface of base pipe 62 is a plurality of ribs 70 having a generally triangular cross section. Importantly, two of the ribs 70 are positioned against each of the nonperforated sections 68 of screen assembly 60. Specifically, ribs 72, 74, ribs 76, 78 and ribs 80, 82 are respectively positioned against nonperforated sections 68. Wrapped around and welded to ribs 70 is a screen wire 84. Screen wire 84 forms a plurality of turns, such as turn 86, turn 88 and turn 90. Between each of the turns is a gap through which formation fluids flow such as gap 92 between turns 86, 88 and gap 94 between turns 88, 90. The gaps in the sections of screen wire 84 that are circumferentially aligned with nonperforated sections 68 of base pipe 62 are sealed with a filler material 96. Filler material 96 is selectively placed in the gaps between the turns of screen wire 84 such that fluid sealed slurry passageways 98 are created between respective nonperforated sections 68, ribs 70 and sealed sections 100 of screen wire 84.

Positioned at selected intervals, such as every five to ten feet, along each screen section of sand control screen assembly 140 and within slurry passageways 98 are tube segments 142, as best seen in FIG. 8. In the illustrated embodiment, tube segments 142 are welded within slurry passageways 98. Tube segments 142, which may be several inches to a foot long, are used to support screen wire 84 such that exit ports 144 may be drilled therethrough. A portion of the fluid slurry traveling through tube segments 142 will enter the annular interval surrounding screen assembly 140 via exit ports 144. The remainder of the fluid slurry passes through tube segments 142 and enters the next section of slurry passageways 98. This process continues through the various levels of screen assembly 140 along the entire length of the interval to be gravel packed such that a complete gravel pack of the interval can be achieved.

Figure 9:
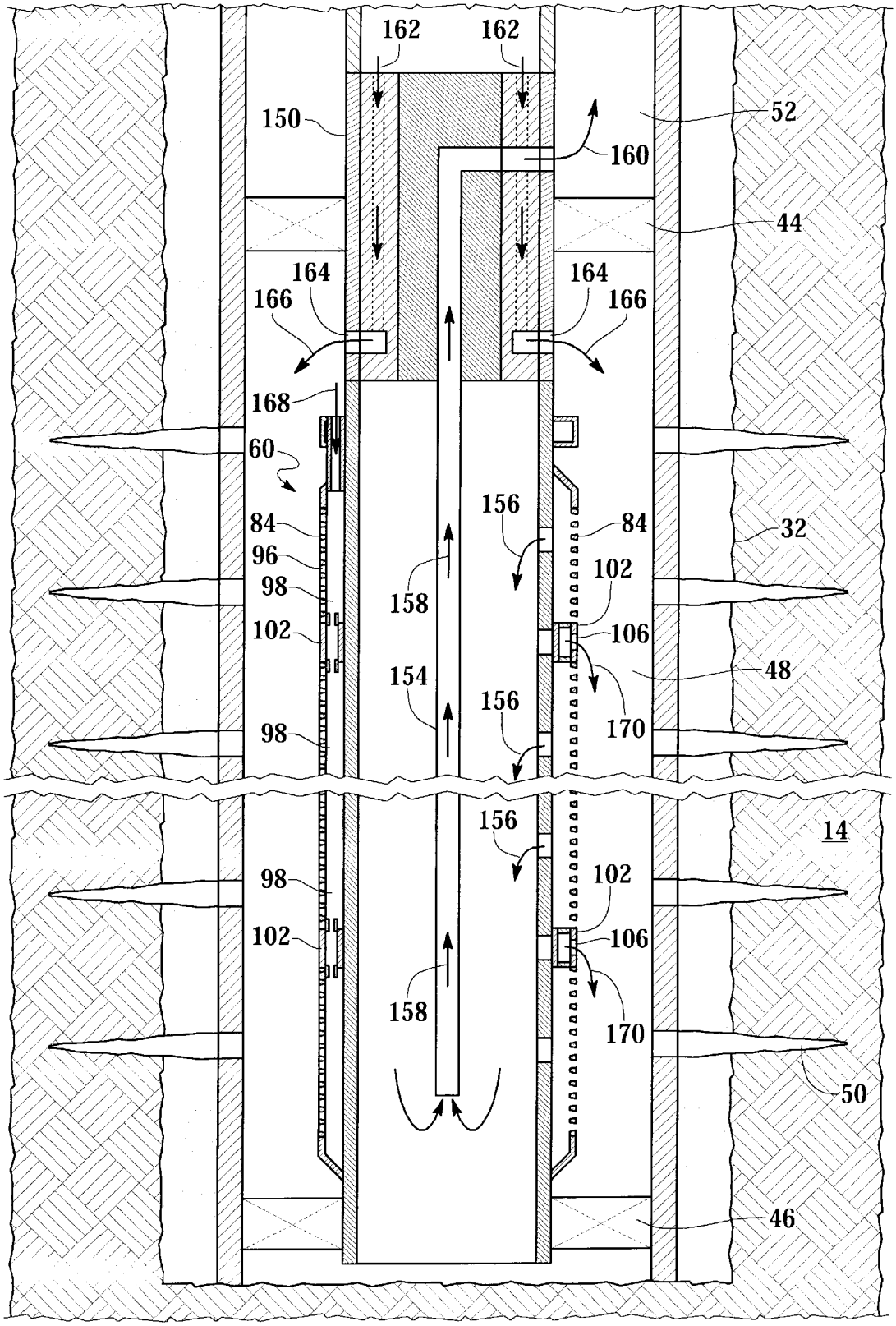
FIG. 9 is a half sectional view depicting the operation of a sand control screen assembly for gravel packing an interval of a wellbore of the present invention.

Referring now to FIG. 9, a typical completion process using screen assembly 60 for gravel packing an interval of a wellbore of the present invention will be described. First, screen assembly 60 is positioned within wellbore 32 proximate formation 14 and interval 48 adjacent to formation 14 is isolated. Packer 44 seals the upper end of annular interval 48 and packer 46 seals the lower end of annular interval 48. Cross-over assembly 150 is located adjacent to screen assembly 60, traversing packer 44 with portions of cross-over assembly 150 on either side of packer 44. When the gravel packing operation commences, the objective is to uniformly and completely fill interval 48 with gravel. To help achieve this result, wash pipe 154 is disposed within screen assembly 60. Wash pipe 154 extends into cross-over assembly 150 such that return fluid passing through screen assembly 60, indicated by arrows 156, may travel through wash pipe 154, as indicated by arrow 158, and into annulus 52, as indicted by arrow 160, for return to the surface.

The fluid slurry containing gravel is pumped down work string 30 into cross-over assembly 150 along the path indicated by arrows 162. The fluid slurry containing gravel exits cross-over assembly 150 through cross-over ports 164 and is discharged into annular interval 48 as indicated by arrows 166. This is the primary path as the fluid slurry seeks the path of least resistance. Under ideal conditions, the fluid slurry travels throughout the entire interval 48 until interval 48 is completely packed with gravel. If, however, a sand bridge forms in annular interval 48 before the gravel packing operation is complete, the fluid slurry containing gravel will enter slurry passageways 98 of screen assembly 60 to bypass the sand bridge as indicated by arrow 168. The fluid slurry then travels within slurry passageways 98 with some of the fluid slurry exiting screen assembly 60 at each of the manifolds 102 through exit ports 106, as indicated by arrows 170.

As the fluid slurry containing gravel enters annular interval 48, the gravel drops out of the slurry and builds up from formation 14, filling perforations 50 and annular interval 48 around screen assembly 60 forming the gravel pack. Some of the carrier fluid in the slurry may leak off through perforations 50 into formation 14 while the remainder of the carrier fluid passes through screen assembly 60, as indicated by arrows 156, that is sized to prevent gravel from flowing therethrough. The fluid flowing back through screen assembly 60, as explained above, follows the paths indicated by arrows 158, 160 back to the surface.

In operation, the screen assembly for gravel packing an interval of a wellbore of the present invention is used to distribute the fluid slurry to various locations within the interval to be gravel packed by injecting the fluid slurry into the slurry passageways of the screen assembly when sand bridge formation occurs. The fluid slurry exits through the various exit ports in the manifolds along the length of the screen assembly into the annulus between the screen assembly and the wellbore which may be cased or uncased. Once in this annulus, a portion of the gravel in the fluid slurry is deposited around the screen assembly in the annulus such that the gravel migrates both circumferentially and axially from the exit ports. This process progresses along the entire length of the screen assembly such that the annular area becomes completely packed with the gravel. Once the annulus is completely packed with gravel, the gravel pack operation may cease.

Alternatively, it should be noted by those skilled in the art that instead of first injecting the fluid slurry directly into annular interval 48 until a sand bridge forms, the fluid slurry may initially be injected directly into the slurry passageways of the screen assembly for gravel packing an interval of a wellbore of the present invention. In either embodiment, once the gravel pack is completed and the well is brought on line, formation fluids that are produced into the gravel packed interval must travel through the gravel pack in the annulus prior to entering the sand control screen assembly. As such, the screen assembly for gravel packing an interval of a wellbore of the present invention allows for a complete gravel pack of an interval so that particulate materials in the formation fluid are filtered out.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly for gravel packing an interval of a wellbore, the screen assembly comprising: Image Page 2 a base pipe having a perforated section and a nonperforated section;

a plurality of ribs circumferentially spaced around and axially extending along the exterior surface of the base pipe, two of the ribs positioned within the nonperforated section of the base pipe;

a filter medium positioned around the plurality of ribs having voids therethrough;

a filler material disposed within a portion of the voids that is circumferentially aligned with the nonperforated section of the base pipe, thereby forming a slurry passageway bounded by the nonperforated section of the base pipe, the two ribs positioned within the nonperforated section of the base pipe and the portion of the filter medium and the filler material in the voids that are circumferentially aligned with the nonperforated section of the base pipe; and a plurality of manifolds in fluid communication with the slurry passageway, the manifolds deliver a fluid slurry to a plurality of levels of the interval through exit ports when the screen assembly is in an operable position.

2. The screen assembly as recited in claim 1 wherein each of the manifolds is positioned between sections of the slurry passageway and wherein a tube extends from the manifolds into each section of the slurry passageway.

3. The screen assembly as recited in claim 1 wherein the exit ports of the manifolds are not circumferentially aligned with the slurry passageway.

4. The screen assembly as recited in claim 1 wherein the exit ports of the manifolds are circumferentially aligned with the slurry passageway.

5. The screen assembly as recited in claim 1 wherein the ribs have a substantially triangular cross section.

6. The screen assembly as recited in claim 1 wherein the base pipe further comprises a plurality of perforated sections and a plurality of nonperforated sections, wherein two of the ribs are positioned within each of the nonperforated sections and wherein the filler material is disposed within the portions of the voids that are circumferentially aligned with each nonperforated section, thereby forming a plurality of slurry passageways.

7. The screen assembly as recited in claim 1 wherein the screen assembly further comprises a plurality of sand control screens each including a portion of the slurry passageway and wherein one of the manifolds is positioned between each of the sand control screens providing fluid communication between the portions of the slurry passageway of adjacent sand control screens and delivering the fluid slurry into the interval.

8. The screen assembly as recited in claim 1 wherein the filter medium is a screen wire wrapped around the ribs and wherein the voids are gaps between adjacent turns of the screen wire.

9. A sand control screen assembly for gravel packing an interval of a wellbore, the screen assembly comprising:

a base pipe having a perforated section and a nonperforated section;

a plurality of ribs circumferentially spaced around and axially extending along the exterior surface of the base pipe, two of the ribs positioned within the nonperforated section of the base pipe;

a filter medium positioned around the plurality of ribs having voids therethrough;

a filler material disposed within a portion of the voids that is circumferentially aligned with the nonperforated section of the base pipe, thereby forming a slurry passageway bounded by the nonperforated section of the base pipe, the two ribs positioned within the nonperforated section of the base pipe and the portion of the filter medium and the filler material in the voids that are circumferentially aligned with the nonperforated section of the base pipe; and a plurality of manifolds in fluid communication with the slurry passageway, the manifolds deliver a fluid slurry to a plurality of levels of the interval through exit ports that are not circumferentially aligned with the slurry passageway when the screen assembly is in an operable position.

10. The screen assembly as recited in claim 9 wherein each of the manifolds is positioned between sections of the slurry passageway and wherein a tube extends from the manifolds into each section of the slurry passageway.

11. The screen assembly as recited in claim 9 wherein the ribs have a substantially triangular cross section.

12. The screen assembly as recited in claim 9 wherein the base pipe further comprises a plurality of perforated sections and a plurality of nonperforated sections, wherein two of the ribs are positioned within each of the nonperforated sections and wherein the filler material is disposed within the portions of the voids that are circumferentially aligned with each nonperforated section, thereby forming a plurality of slurry passageways.

13. The screen assembly as recited in claim 9 wherein the screen assembly further comprises a plurality of sand control screens each including a portion of the slurry passageway and wherein one of the manifolds is positioned between each of the sand control screens providing fluid communication between the portions of the slurry passageway of adjacent sand control screens and delivering the fluid slurry into the interval.

14. The screen assembly as recited in claim 9 wherein the filter medium is a screen wire wrapped around the ribs and wherein the voids are gaps between adjacent turns of the screen wire.

15. A sand control screen assembly for gravel packing an interval of a wellbore, the screen assembly comprising:

a base pipe having a perforated section and a nonperforated section;

a plurality of ribs circumferentially spaced around and axially extending along the exterior surface of the base pipe, two of the ribs positioned within the nonperforated section of the base pipe;

a filter medium positioned around the plurality of ribs having voids therethrough;

a filler material disposed within a portion of the voids that is circumferentially aligned with the nonperforated section, thereby forming a slurry passageway bounded by the nonperforated section, the two ribs positioned within the nonperforated section and the portion of the filter medium and the filler material in the voids that are circumferentially aligned with the nonperforated section;

a plurality of tubes selectively positioned within the slurry passageway; and a plurality of exit ports through the filter medium, the filler material in the voids that are circumferentially aligned with the nonperforated section and the tubes to deliver a fluid slurry to a plurality of levels of the interval when the screen assembly is in an operable position.

16. The screen assembly as recited in claim 15 wherein the ribs have a substantially triangular cross section.

17. The screen assembly as recited in claim 15 wherein the base pipe further comprises a plurality of perforated sections and a plurality of nonperforated sections, wherein two of the ribs are positioned within each of the nonperforated sections and wherein the filler material is disposed within the portions of the voids that are circumferentially aligned with each nonperforated section, thereby forming a plurality of slurry passageways.

18. The screen assembly as recited in claim 15 wherein the screen assembly further comprises a plurality of sand control screens each including a portion of the slurry passageway and wherein a manifold is positioned between each of the sand control screens providing fluid communication between the portions of the slurry passageway of adjacent sand control screens and delivering the fluid slurry into the interval.

19. The screen assembly as recited in claim 15 wherein the filter medium is a screen wire wrapped around the ribs and wherein the voids are gaps between adjacent turns of the screen wire.

20. A method for gravel packing an interval of a wellbore, the method comprising the steps of:

traversing a formation with the wellbore;

positioning a sand control screen assembly within the wellbore, the screen assembly including a base pipe having a perforated section and a nonperforated section, a plurality of ribs circumferentially spaced therearound and a filter medium positioned around the plurality of ribs having voids therethrough, the screen assembly also includes a slurry passageway defined by the nonperforated section of the base pipe, two of the ribs which are positioned within the nonperforated section of the base pipe and a portion of the filter medium that is circumferentially aligned with the nonperforated section of the base pipe, the voids in the portion having a filler material disposed therein;

injecting a fluid slurry containing gravel through the slurry passageway such that the fluid slurry exits the screen assembly through exit ports in manifolds that are in fluid communication with the slurry passageway at a plurality of levels of the interval; and terminating the injecting.

21. The method as recited in claim 20 further comprising the step of positioning at least some of the manifolds between sections of the slurry passageway within each of the sand control screens of the screen assembly and extending a tube from each of the manifolds into each section of the slurry passageway.

22. The method as recited in claim 20 further comprising the step of circumferentially misaligning the exit ports of the manifolds with the slurry passageway.

23. The method as recited in claim 20 further comprising the step of circumferentially aligning the exit ports of the manifolds with the slurry passageway.

24. The method as recited in claim 20 wherein the ribs have a substantially triangular cross section.

25. The method as recited in claim 20 wherein the step of injecting a fluid slurry containing gravel through the slurry passageway further comprises injecting the fluid slurry containing gravel through a plurality of slurry passageways, each slurry passageway being defined by one of a plurality of nonperforated sections, a pair of the ribs positioned within each of the nonperforated sections and the portions of the filter medium having filler material in the voids that are circumferentially aligned with each nonperforated section.

26. The method as recited in claim 20 wherein the step of positioning a screen assembly within the wellbore further comprises:

positioning a screen assembly within the wellbore that includes a plurality of sand control screens each including a portion of the slurry passageway;

positioning one of the manifolds between each of the sand control screens;

providing fluid communication between the portions of the slurry passageway of adjacent sand control screens through the manifolds; and delivering the fluid slurry into the interval from the manifolds.

27. A method for gravel packing an interval of a wellbore, the method comprising the steps of:

traversing a formation with the wellbore;

positioning a sand control screen assembly within the wellbore, the screen assembly including a base pipe having a perforated section and a nonperforated section, a plurality of ribs circumferentially spaced therearound and a filter medium positioned around the plurality of ribs having voids therethrough, the screen assembly also includes a slurry passageway defined by the nonperforated section of the base pipe, two of the ribs which are positioned within the nonperforated section of the base pipe and a portion of the filter medium that is circumferentially aligned with the nonperforated section of the base pipe, the voids in the portion having a filler material disposed therein;

injecting a fluid slurry containing gravel through the slurry passageway such that the fluid slurry exits the screen assembly through exit ports in manifolds that are not circumferentially aligned with the slurry passageway at a plurality of levels of the interval; and terminating the injecting.

28. The method as recited in claim 27 further comprising the step of positioning at least some of the manifolds between sections of the slurry passageway within each sand control screen of the screen assembly and extending a tube from the manifolds into each section of the slurry passageway.

29. The method as recited in claim 27 wherein the ribs have a substantially triangular cross section.

30. The method as recited in claim 27 wherein the step of injecting a fluid slurry containing gravel through the slurry passageway further comprises injecting the fluid slurry containing gravel through a plurality of slurry passageways, each slurry passageway being defined by one of a plurality of nonperforated sections, a pair of the ribs positioned within each of the nonperforated sections and the portions of the filter medium having filler material in the voids that are circumferentially aligned with each nonperforated section.

31. The method as recited in claim 27 wherein the step of positioning a screen assembly within the wellbore further comprises:

positioning a screen assembly within the wellbore that includes a plurality of sand control screens each including a portion of the slurry passageway;

positioning one of the manifolds between each of the sand control screens;

providing fluid communication between the portions of the slurry passageway of adjacent sand control screens through the manifolds; and delivering the fluid slurry into the interval from the manifolds.

32. A method for gravel packing an interval of a wellbore, the method comprising the steps of:

traversing a formation with the wellbore;

positioning a sand control screen assembly within the wellbore, the screen assembly including a base pipe having a perforated section and a nonperforated section, a plurality of ribs circumferentially spaced therearound and a filter medium positioned around the plurality of ribs having voids therethrough, the screen assembly also includes a slurry passageway defined by the nonperforated section of the base pipe, two of the ribs which are positioned within the nonperforated section of the base pipe and a portion of the filter medium that is circumferentially aligned with the nonperforated section of the base pipe, the voids in the portion having a filler material disposed therein;

injecting a fluid slurry containing gravel through the slurry passageway such that the fluid slurry exits the screen assembly through exit ports in the filter medium and filler material at a plurality of levels of the interval; and terminating the injecting.

33. The method as recited in claim 32 further comprising the step of positioning tubes within the slurry passageway at the locations of the exit ports and extending the exit ports through the tubes.

34. The method as recited in claim 33 wherein the ribs have a substantially triangular cross section.

35. The method as recited in claim 33 wherein the step of injecting a fluid slurry containing gravel through the slurry passageway further comprises injecting the fluid slurry containing gravel through a plurality of slurry passageways, each slurry passageway being defined by one of a plurality of nonperforated sections in the base pipe, a pair of the ribs positioned within each of the nonperforated sections and the portions of the filter medium having filler material in the voids that are circumferentially aligned with each nonperforated section.

36. The method as recited in claim 33 wherein the step of positioning a screen assembly within the wellbore further comprises:

positioning a screen assembly within the wellbore that includes a plurality of sand control screens each including a portion of the slurry passageway;

positioning one of the manifolds between each of the sand control screens;

providing fluid communication between the portions of the slurry passageway of adjacent sand control screens through the manifolds; and delivering the fluid slurry into the interval from the manifolds.

37. A sand control screen assembly for gravel packing an interval of a wellbore, the screen assembly comprising:

a base pipe having a plurality of openings;

a filter medium positioned around the base pipe;

a slurry passageway positioned between the base pipe and the filter medium; and a plurality of manifolds in fluid communication with the slurry passageway, the manifolds deliver a fluid slurry to a plurality of levels of the interval through exit ports when the screen assembly is in an operable position.

38. A sand control screen assembly for gravel packing an interval of a wellbore, the screen assembly comprising:

a base pipe having a plurality of openings;

a filter medium positioned around the base pipe;

a slurry passageway positioned between the base pipe and the filter medium; and a plurality of manifolds in fluid communication with the slurry passageway, the manifolds deliver a fluid slurry to a plurality of levels of the interval through exit ports that are not circumferentially aligned with the slurry passageway when the screen assembly is in an operable position.

* * * * *